US006938971B2

(12) United States Patent
Gom z et al.

(10) Patent No.: US 6,938,971 B2
(45) Date of Patent: Sep. 6, 2005

(54) METHOD OF SERVICING A PEN WHEN MOUNTED IN A PRINTING DEVICE

(75) Inventors: Rosa Maria Gom z, Sant Cugat del Valles (ES); Jose Jurjo, Barcelona (ES); Tod S. Heiles, Vancouver, WA (US); Marc Serra, Barcelona (ES); Ramon Vega, Sabadell Barcelona (ES); Xavier Bruch, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/886,414

(22) Filed: Jun. 21, 2001

(65) Prior Publication Data

US 2002/0196304 A1 Dec. 26, 2002

(51) Int. Cl.[7] ..... B41J 29/38
(52) U.S. Cl. ..... 347/14; 347/19; 347/23
(58) Field of Search ..... 347/14, 19, 23

(56) References Cited

U.S. PATENT DOCUMENTS 4,328,504 A * 5/1982 Weber et al. ..... 347/19
4,977,459 A * 12/1990 Ebinuma et al. ..... 347/23
5,353,387 A * 10/1994 Petschik et al. ..... 347/15
5,398,054 A * 3/1995 Fukazawa et al. ..... 347/33
5,434,605 A * 7/1995 Osborne ..... 347/23
5,455,608 A * 10/1995 Stewart et al. ..... 347/23
5,583,547 A * 12/1996 Gast et al. ..... 347/22
5,596,353 A * 1/1997 Takada et al. ..... 347/19
6,045,206 A * 4/2000 Igval ..... 347/2
6,056,386 A * 5/2000 Nohata et al. ..... 347/19
6,179,403 B1 * 1/2001 Xie et al. ..... 347/23

FOREIGN PATENT DOCUMENTS

EP 1 065 056 A1 * 1/2001 ..... B41J/2/01

OTHER PUBLICATIONS

Frank Cost, Pocket Guide to Digital Printing, 1997, Thomson Learning, p. 16–18.*

* cited by examiner

*Primary Examiner*—Lamson Nguyen
*Assistant Examiner*—Blaise Mouttet

(57) ABSTRACT

A method and apparatus for servicing a pen in an inkjet printing device includes receiving a print job, determining a level of print quality required for the print job, detecting the operating characteristics of a number of nozzles to be used to print the print job; and, in the event that the operating characteristics of the nozzles are sufficient to meet the level of print quality, printing the print job. A maintenance procedure may be scheduled in the event that an individual one of the nozzles is not fully functional. In addition, the maintenance procedure may be scheduled to be performed during a time when the inkjet printing device is idle.

27 Claims, 6 Drawing Sheets

METHOD OF SERVICING A PEN WHEN MOUNTED IN A PRINTING DEVICE

FIELD OF THE INVENTION

The present invention relates to inkjet printing devices, and, in particular, to a method and apparatus for servicing a printing component when mounted in an inkjet printing device.

BACKGROUND OF THE INVENTION

Inkjet printing mechanisms may be used in a variety of different printing devices, such as plotters, facsimile machines and inkjet printers, collectively referred to herein as printers. These printing mechanisms typically use a printhead to shoot drops of ink onto a page or sheet of print media. Some inkjet print mechanisms utilize a type of printhead called a cartridge that carries a self contained ink supply back and forth across the media. In the case of a multi-color cartridge, several printheads and reservoirs may be combined into a single unit, with each reservoir/pen combination for a given color being referred to herein as a "pen."

Other inkjet print mechanisms, known as "off-axis" systems, propel only a small amount of ink in the printhead across the media, and include a main ink supply in a separate reservoir, which is located "off-axis" from the path of printhead travel. Typically, a flexible conduit or tubing is used to convey the ink from the reservoir to the printhead. In these types of print mechanisms the printhead itself is referred to as a "pen". A pen may also have a cap or capping mechanism such that when the pen is not printing, the pen is covered. This may serve to prevent the pen from drying and/or to otherwise protect the pen from the environment.

Each pen includes very small nozzles through which the ink drops are fired. The particular ink ejection mechanism within the pen may take on a variety of different forms known to those skilled in the art, such as those using piezo-electric or thermal pen technology. For instance, two earlier thermal ink ejection mechanisms are shown in U.S. Pat. Nos. 5,278,584 and 4,683,481, both assigned to the present assignee, Hewlett Packard Company. In a thermal ejection system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To print an image, the pen is scanned back and forth across above the media in an area known as a print zone, with the pen shooting drops of ink as it moves. By selectively energizing the resistors as the pen moves across the media, the ink is expelled in a pattern on the media to form a desired image (e.g., picture, chart or text). The nozzles are typically arranged in one or more linear arrays. If more than one linear array is utilized, the linear arrays may be located side-by-side on the pen, parallel to one another, and substantially perpendicular to the scanning direction. As such, the length of the nozzle arrays defines a print swath or band. That is, if all the nozzles of one array were continually fired as the pen made one complete traverse through the print zone, a band or swath of ink would appear on the sheet. The height of this band is known as the "swath height" of the pen, the maximum pattern of ink which can be laid down in a single pass.

The orifice plate of the pen tends to accumulate contaminants, such as paper dust, and the like, during the printing process. Such contaminants may adhere to the orifice plate for various reasons including the presence of ink on the pen, or because of electrostatic charges that may build up during operation. In addition, excess dried ink may accumulate around the pen. The accumulation of ink or other contaminants may impair the quality of the output by interfering with the proper application of ink to the printing medium. Also, if color pens are used, each pen may have different nozzles which each expel different colors. If ink accumulates on the orifice plate, a mixing of different colored inks, known as cross-contamination, can result during use. If colors are mixed on the orifice plate, the quality of the resulting printed product can be affected. Furthermore, the nozzles of an ink-jet printer can clog, particularly if the pens are left uncapped for a period of time. For these reasons, it is desirable to service the pen by clearing the pen orifice plate of such contaminants and ink on a routine basis to prevent the build up thereof. This may be accomplished by a service procedure where a pen expels ink, is brought in contact with a wiper and expels ink again, also called a spit, wipe spit procedure. In some printers this service procedure is performed at the end of a print job based on certain criteria, for example, the number of drops fired since the last spit, wipe, spit procedure, the time a pen has been uncapped, upon a user request, when power has first been applied to the printer, etc. Service procedures such as the spit, wipe, spit procedure are desirable to maintain print quality but also contribute to increased print time because of the time required to perform the procedure and shorter pen life because wiping over time may degrade the nozzle plate by scratching and distorting the surface.

U.S. Pat. No. 5,455,608 describes how a printer may schedule service on a pen solely based on the result of a drop detection step. Before starting a plot the printer performs a drop detection on all pens present to detect if any nozzles are non-firing, also referred to as a "nozzle out" condition. If a nozzle out condition is detected in a pen, the printer triggers an automatic recovery servicing process for servicing the malfunctioning pen to clear or otherwise recover the malfunctioning nozzle.

This process includes a sequence of nozzle recovery or clearing procedures of increasing severity. At the end of each procedure a new drop detection test is performed on the pen, to detect if the pen is fully recovered. If the drop detection test indicates that a nozzle out condition continues to exist, another servicing procedure is performed. If, after a predetermined number of procedures, the pen is still not fully recovered (i.e. at least one nozzle is still out) the user is instructed to replace the pen or to discontinue the current nozzle check. Thus, a "nozzle health" detection is performed before each print job and recovery procedures are performed based on a fixed threshold, in this example, at least one nozzle remaining non-firing.

One disadvantage of this particular process is that if the printer is not able to fully recover the failing nozzles, some nozzles are unstable, or the system is unable to compensate for the failing nozzles using error hiding techniques, the system may recognize that the pen is not fully recovered and may run the recovery servicing process at various times, for example, at the beginning of each print job, when the nozzle health indicates that the service process is required, or upon a user request. The system may run the recovery process until the pen has been fully recovered or replaced. This may lead to an unacceptable loss of throughput and a loss of printer productivity because the automatic recovery process is very time consuming, the recovery process consumes a large quantity of ink, particularly when running a priming function included in the recovery process, and before each plot, the printer directs the user to replace the pen or to discontinue the current nozzle check.

Another disadvantage of this process is that the pen is designated as either "able to print" or "unable to print" solely based on the number of nozzles either working or not working.

SUMMARY OF THE INVENTION

It would be advantageous to perform service procedures in a manner that has a minimal impact on printing throughput. It would also be advantageous to perform service procedures based on a set of flexible criteria rather than simply upon a number of working nozzles.

Accordingly, it is an object of this invention to provide a method and apparatus for performing service procedures in a manner that has a reduced impact on printer throughput.

It is another object of this invention to perform service procedures based on a set of criteria determined at the time a plot is to be executed based on criteria related to the quality required for the particular print job.

A method and apparatus for servicing a pen in an inkjet printing device includes receiving a print job, determining a level of print quality required for the print job, detecting the operating characteristics of a number of nozzles to be used to print the print job; and, in the event that the operating characteristics of the nozzles are sufficient to meet the level of print quality, printing the print job. A maintenance procedure may be scheduled in the event that an individual one of the nozzles is not fully functional. In addition, the maintenance procedure may be scheduled to be performed during a time when the inkjet printing device is idle.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
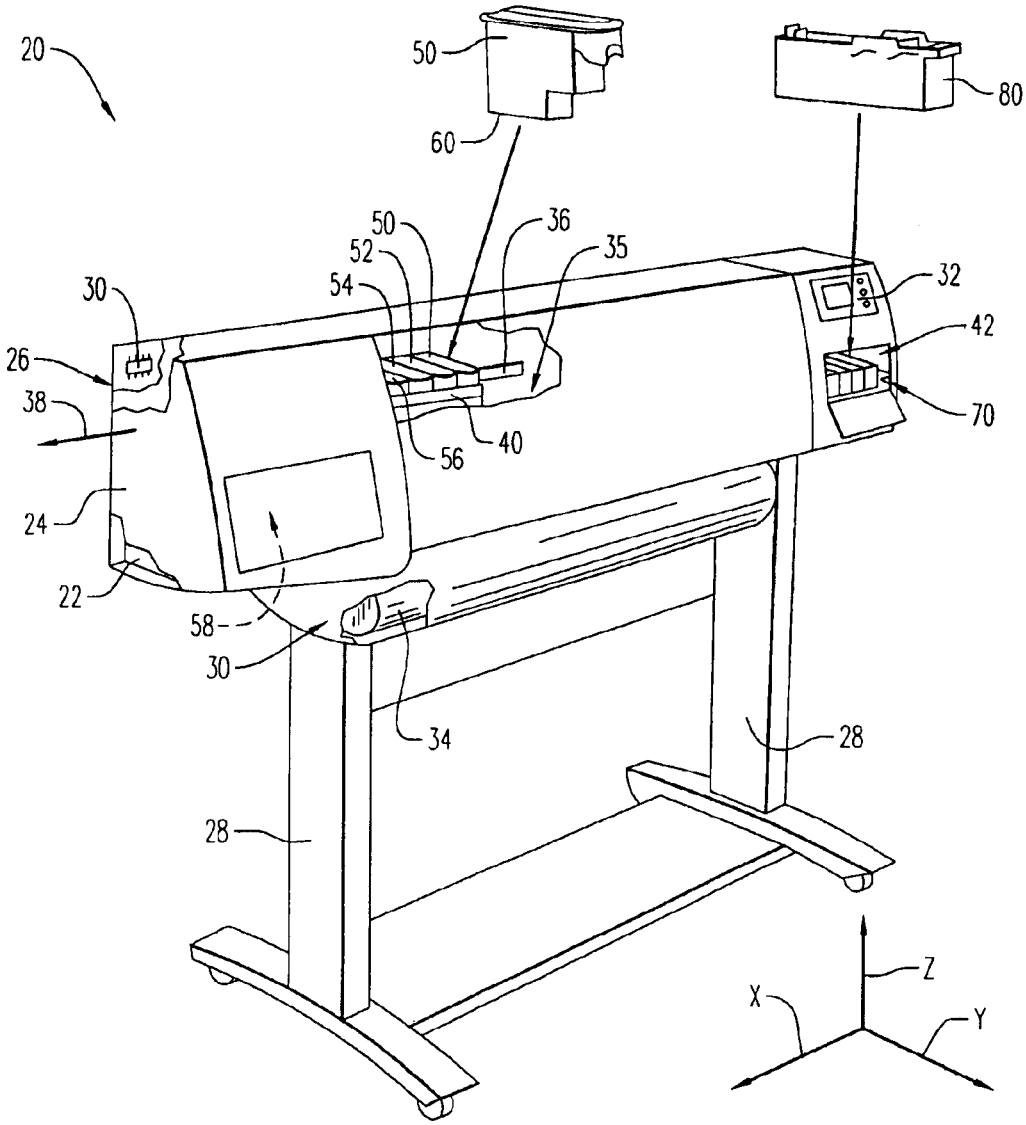
FIG. 1 is a perspective view of a printer in accordance with the invention in cut-away form.

FIG. 1 shows an example of a large format inkjet printer 20, also called a plotter, in accordance with the present invention. Plotters are usually used for printing conventional engineering and architectural drawings as well as high quality poster-sized images, and the like, in an industrial, office, home, or other environment.

Inkjet printing mechanisms are commercially available in many different types of products. For instance, some of the commercially available products that may embody the present invention include desk top printers, portable printing units, copiers, cameras, video printers, facsimile machines, etc.

The printer 20 in this example includes a chassis 22 surrounded by an enclosure 24, forming a printer assembly 26. The printer assembly 26 may be supported on a desk or tabletop, but is preferably supported by a pair of leg assemblies 28. The printer 20 also has a controller, illustrated schematically as a processor 30, that receives instructions from a host device, typically a computing device, for example, a personal computer, a mainframe, etc.

The printer 20 may also include a key pad and display panel 32, which provides a user interface where the display provides information to a user and the keypad accepts input from the user. A monitor (not shown) coupled to the host device may also be used to display visual information to an operator, such as printer status, service requirements, error conditions, etc.

A conventional print media handling system (not shown) may be used to advance a continuous sheet of print media 34 through a print zone 35. The print media may be any type of suitable sheet material, such as paper, poster board, fabric, transparencies, mylar, etc. A carriage guide rod 36 is mounted to the chassis 22 to define a scanning axis 38, with the guide rod 36 slideably supporting a pen carriage 40 for travel back and forth, reciprocally, across the print zone 35. A conventional carriage drive motor (not shown) may be used to propel the carriage 40 in response to a control signal received from the controller 30. To provide carriage position information to controller 30, a conventional metallic encoder strip (not shown) may be extended along the length of the print zone 35 and over the servicing region 42. A conventional optical encoder reader may be mounted on the back surface of pen carriage 40 to read positional information provided by the encoder strip, for example, as described in U.S. Pat. No. 5,276,970, also assigned to Hewlett-Packard Company, the assignee of the present invention. The manner of providing positional feedback information may also be accomplished in a variety of other ways. Upon completion of a print job, the carriage 40 may be used to drag a cutting mechanism across the final trailing portion of the media to sever the printed portion of the media from the remainder of the continuous sheet 34. Moreover, the printer 20 may also be capable of printing on precut sheets, rather than on continuous sheet media 34.

Figure 2:
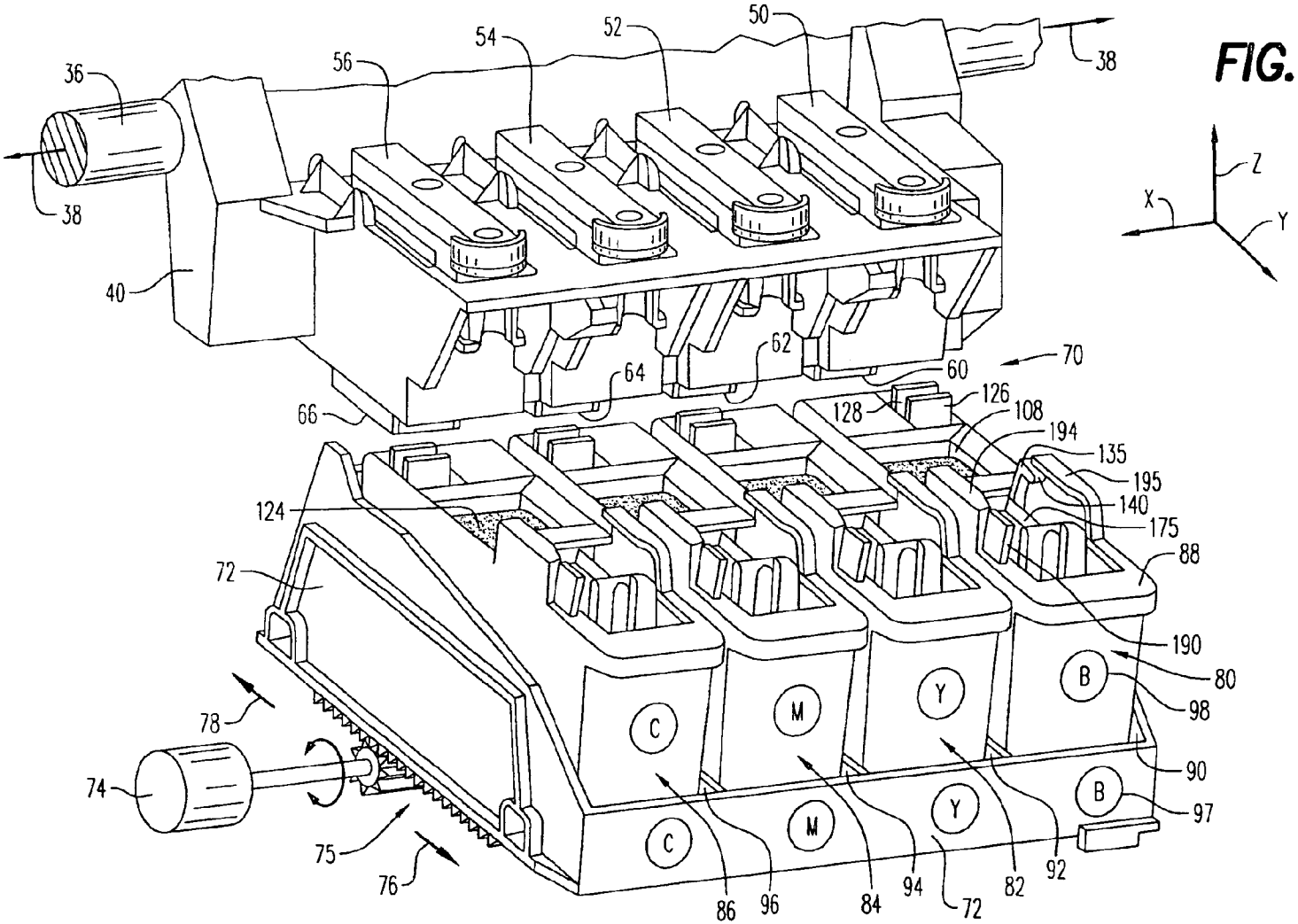
FIG. 2 is a perspective view of a pen service station.

In the print zone 35, the media 34 receives ink from at least one pen, for example, a black ink pen 50 and three monochrome color ink pens 52, 54 and 56, as shown in FIG. 2.

The black ink pen 50 is illustrated herein as containing a pigment based ink while the color pens 52, 54 and 56 are each described as containing a dye based ink of the colors yellow, magenta and cyan, respectively. It should be understood that the color pens 52, 54, 56 may also contain pigment based inks and that other types of inks may be used in the pens 50, 52, 54, 56 such as paraffin based inks, hybrid inks having both dye and pigment characteristics, and any other type of ink suitable for plotting applications. In a this example the printer 20 uses an "off axis" ink delivery system, having main reservoirs (not shown) for each ink (black, cyan, magenta, yellow) located in an ink supply section 58. In this off axis system, the pens 50, 52, 54, 56 may be replenished by ink conveyed through a conventional flexible tubing system (not shown) from the stationary main reservoirs, so only a small ink supply is propelled by the carriage 40 across the print zone 35 which is located "off axis" from the path of pen travel.

Figure 3:
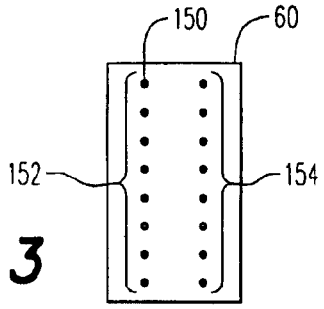
FIG. 3 is a diagram of a pen showing the placement of nozzles on an orifice plate.

The pens 50, 52, 54, 56 each have an orifice plate 60, 62, 64, 66, respectively. As shown in FIG. 3, each orifice plate 60, 62, 64, 66 includes a plurality of nozzles 150. The nozzles 150 of each orifice plate 60, 62, 64, 66 are typically formed in at least one, but typically two linear arrays 152, 154 along the orifice plate. Each linear array is typically aligned in a longitudinal direction substantially perpendicular to the scanning axis 38, with the length of each array determining the maximum image swath for a single pass of a pen.

FIG. 2 shows the carriage 40 positioned with the pens 50, 52, 54, 56 ready to be serviced by a replaceable printhead cleaner service station 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes a number of print head cleaner units corresponding to the number of pens. In this example, the service station 70 includes four replaceable printhead cleaner units 80, 82, 84, 86 for servicing the respective pens 50, 52, 54, 56. Each of the printhead cleaner units 80, 82, 84, 86 include an installation and removal handle 88, which may be gripped by an operator when installing the printhead cleaner units 80, 82, 84, 86 in their respective chambers or stalls 90, 92, 94, 96 defined by the service station pallet 72. To aid an operator in installing the correct printhead cleaner unit 80, 82, 84, 86 in the associated stall 90, 92, 94, 96, the pallet 72 may include indicia, such as a "B" marking 97 corresponding to the black pen 50, with the black printhead cleaner unit 80 also including indicia, such as a "B" marking 98, which may be matched with marking 97 by an operator to assure proper installation.

Each printhead cleaner unit 80, 82, 84, 86 also includes a spittoon chamber 108. The spittoon 108 may be filled with an ink absorber 124, preferably of a foam material, although any suitable absorbing material may be used. The absorber 124 receives ink spit from the pens 60, 62, 64, 66 and holds the ink while the volatiles or liquid components evaporate, leaving the solid components of the ink trapped within the chambers of the foam material. In one embodiment, the spittoon 108 of the black printhead cleaner unit 80 is supplied as an empty chamber, which then fills with a tar like black ink residue over the life of the cleaner unit.

Each printhead cleaner unit 80, 82, 84, 86 may include a dual bladed wiper assembly which has two wiper blades 126 and 128, which are preferably constructed with rounded exterior wiping edges, and an angular interior wiping edge.

The black printhead cleaner unit 80, used to service black pen 50, which may include a pigment based ink, may also include an ink solvent chamber (not shown) which holds an ink solvent. To deliver the solvent from the reservoir to the orifice plate 60, the black cleaner unit 80 preferably includes a solvent applicator or member 135, which underlies the reservoir block.

Each printhead cleaner unit 80, 82, 84, 86 may also include a cap member 175 which can move in the Z axis direction, while also being able to tilt between the X and Y axes, which aids in sealing the pens 60, 62, 64, 66. The cap member 175 preferably has an upper surface which may define a series of channels or troughs, to act as a vent path to prevent depriming the pens 60, 62, 64, 66.upon sealing. An example of such a cap is described in the allowed U.S. patent application Ser. No. 08/566,221 currently assigned to the present assignee, the Hewlett Packard Company.

Figure 4:
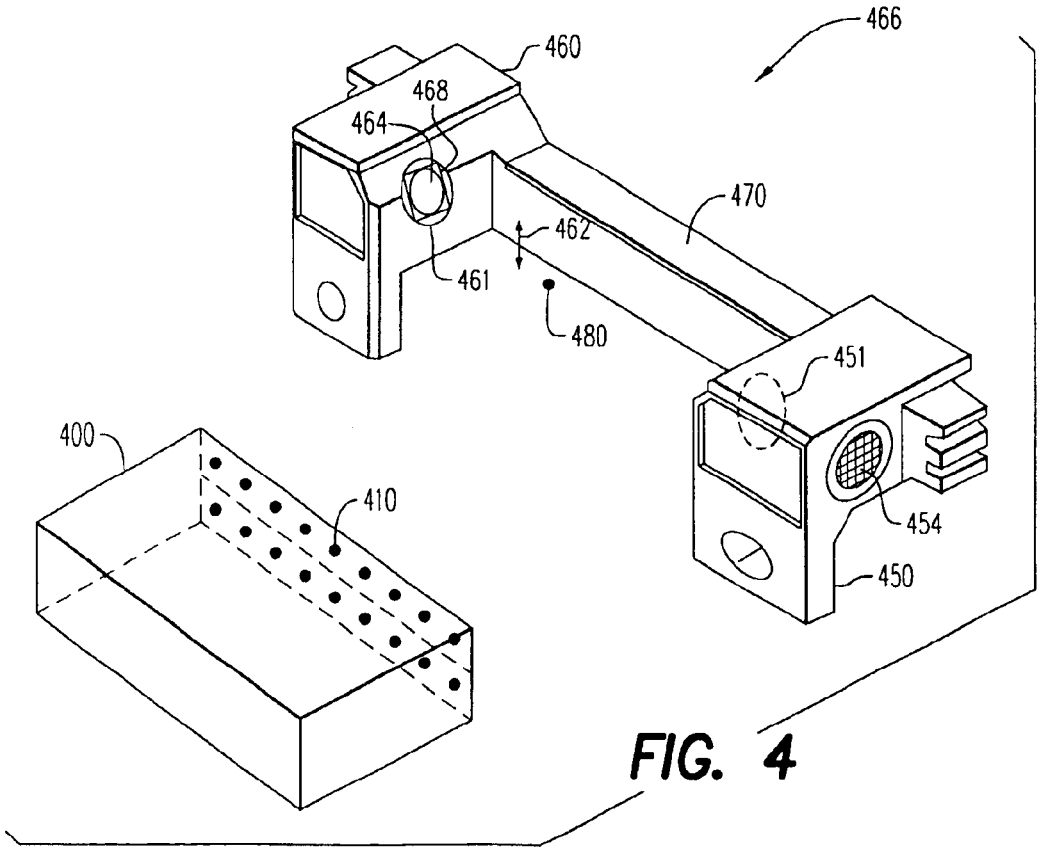
FIG. 4 illustrates a drop detection device.

FIG. 4 shows a schematic representation of a pen and a drop detection device. A pen 400, which may include any one of pens 60, 62, 64, 66 comprises an array of printer nozzles 410. Preferably, the pen 400 includes of two rows of printer nozzles 410, with each row having 524 printer nozzles.

The pen 400 is configured to spray or eject a single droplet or a sequence of droplets of ink 480 from the nozzle 410 in response to commands issued by the controller 30. An emitter 464 is mounted in an emitter housing 460 and a detector 454 is mounted in a detector housing 450. An elongate, substantially straight, rigid member 470 connects the two housings 450, 460. The emitter housing 460, member 470 and detector housing 450 all comprise a substantially rigid assembly 466 configured to actively locate the emitter 464 with respect to the detector 454.

The pen 400, rigid assembly 466, emitter 464, and detector 454 are orientated with respect to each other such that a path traced by the ink droplet 480 passes between the emitter 464 and the detector 454.

A collimator 468 is provided either as part of the emitter 464 or as a separate item so as to collimate radiation emitted by the emitter 464 into a radiation beam which exits the emitter housing 460 via aperture 461. The collimated radiation beam is admitted into detector housing 450 by way of aperture 451 and impinges on detector 454. The ink droplet 480 sprayed from nozzle 410 enters the collimated radiation beam and causes a change in the beam impinging on detector 454.

Various techniques may be employed to detect ink droplets using the drop detection device 466. These may include, for example, spraying a specific number of ink drops from individual nozzles in turn in specific timing sequences to account for the speed of the drops, accounting for the distance between the nozzle and the radiation beam, determining the time the drop spends in the radiation beam etc.

Reference in this regard may be had to applications Ser. No. 09/253,373, now U.S. Pat. No. 6,565,179, entitled "Method Of Detecting The End Of Life Of A Pen" and Ser. No. 09/506,737, now U.S. Pat. No. 6,517,184, entitled "Method of Servicing A Pen When Mounted In A Printing Device. The disclosures of these applications are incorporated by reference.

The drop detector may also be embodied as a "print on media and scan" type drop detector, where a pattern is printed on the media and then scanned to determine various parameters of the pattern. In this embodiment, It is important to note that the ink drop detection device is at least able to determine parameters related to the health of each nozzle. These parameters may include any parameter suitable for determining the functionality of the nozzle.

Figure 5:
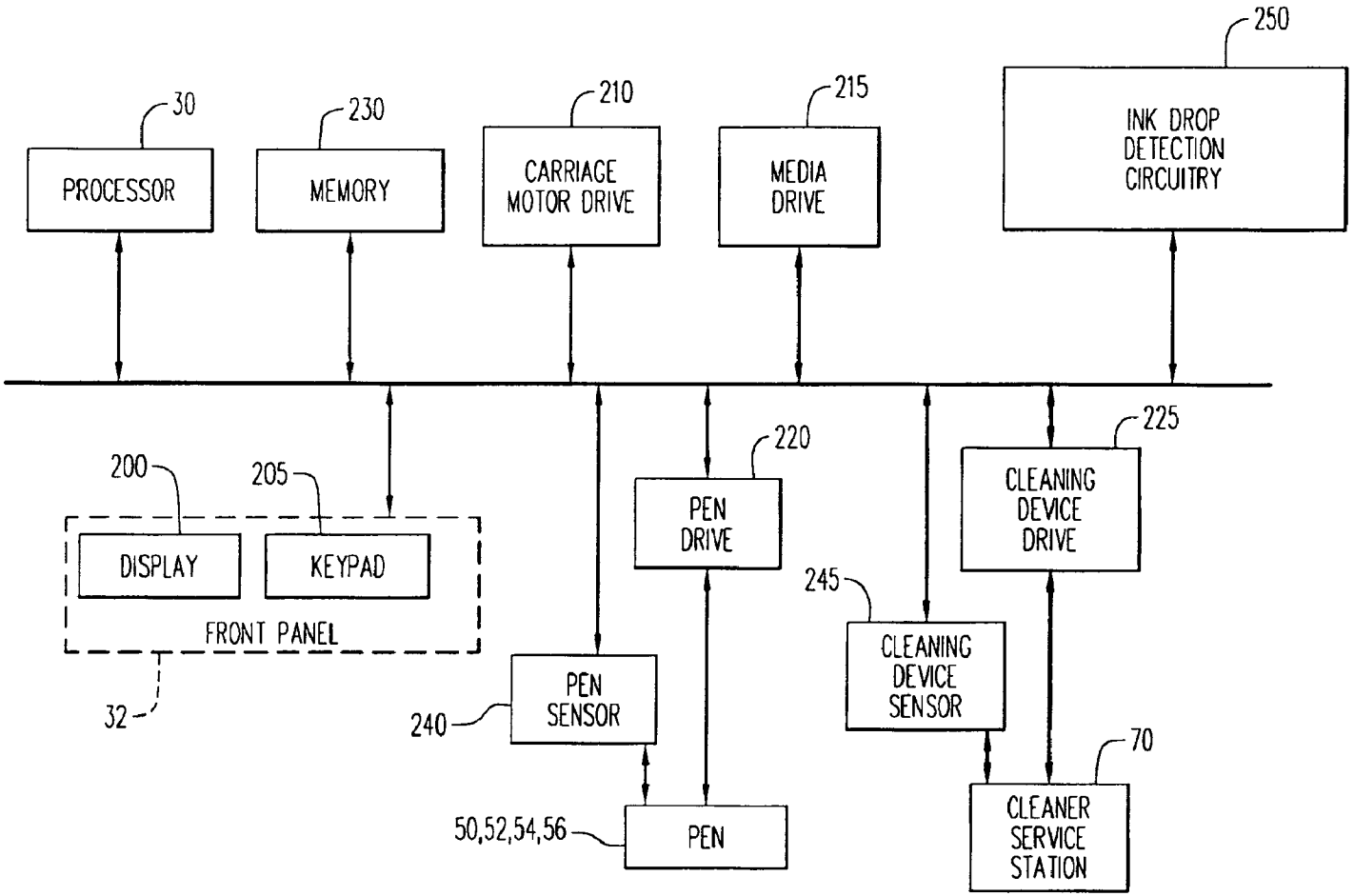
FIG. 5 illustrates schematically a block diagram of the printer.

FIG. 5 shows a block diagram of printer 20. Printer 20 includes the processor 30 for directing printer operations and front panel 32 including a display 200 and keypad 205 for displaying messages to a user and receiving user inputs, respectively. The printer 20 also includes a carriage motor drive 210 for positioning the carriage 40, a media drive 215 that operates to position the media 34, and pen drive circuitry 220 for controlling the individual nozzles on each pen 50, 52, 54, 56. Printer 20 also includes a cleaning device drive 225 for positioning the printhead cleaner service station 70, and memory 230 for storing programs, including a printer operating system, temporary system operating parameters and temporary data.

The processor 30 executes the programs in memory 230 either automatically, in response to user inputs from front panel 32, or in response to inputs from the host device. The programs executed by the processor 30 may include routines for checking the status of various printer components at power up, receiving print jobs, and performing various maintenance and recover actions as described below.

The printer 20 also includes sensors for determining the status of certain components. A pen sensor 240 may record various aspects of the pens 50, 52, 54, 56 including electrical continuity and power supply voltages. A cleaning device sensor 245 may be used to determine if a spittoon, present as part of a particular printhead cleaner unit 80, 82, 84, 86, is full.

Figure 6:
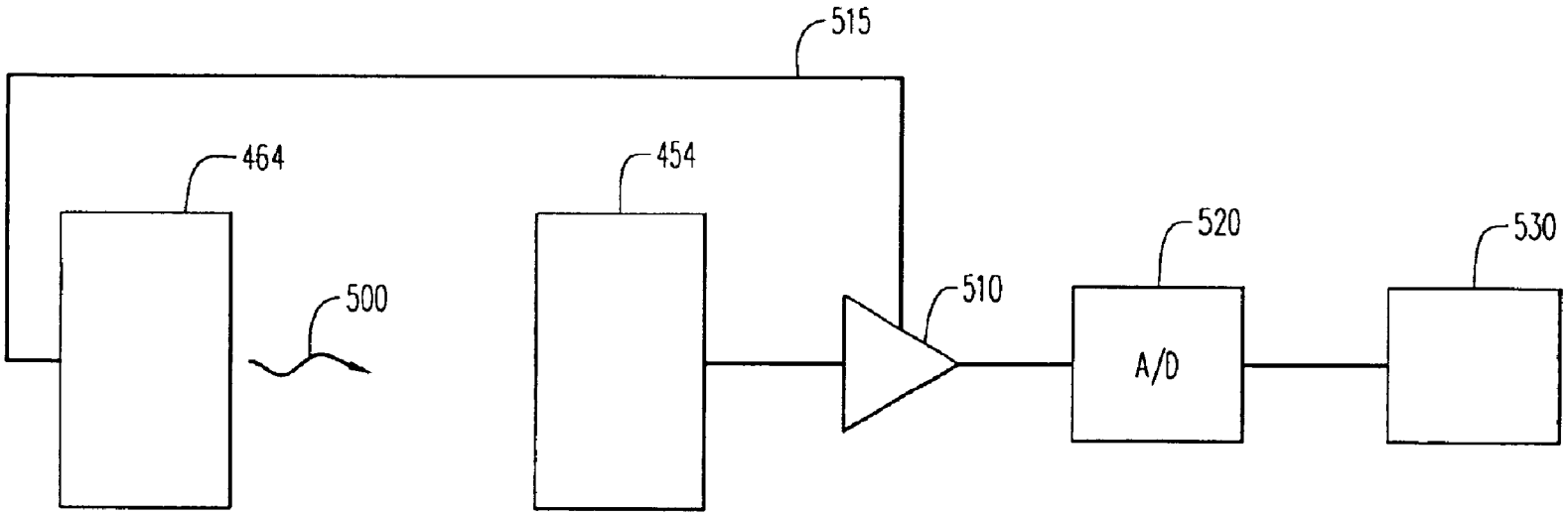
FIG. 6 shows a block diagram of the functional blocks of the drop detection system.

The printer 20 also includes ink drop detection circuitry 250, an example of which is shown in more detail in FIG. 6. The emitter 464 emits radiation 500 which impinges on detector 454. The output current of the detector 454 is amplified by amplifier 510. Additionally, amplifier 510 is configured to increase a driver current to emitter 464 in response to a decrease in an output current of the detector 454 and to decrease an input current into the emitter in response to an increase in the output current of detector 454 via signal path 515. An amplified output current of amplifier 510 is then input into an analogue to digital (A/D) converter 520. The A/D converter 520 samples the amplified output of the photo diode. Preferably, the A/D converter 520 samples the amplified output current 64 times with a sampling frequency of 40 kilohertz. The period between samples is, preferably, 25 $\mu$s yielding a total sampling time of 1.6 milliseconds. The 64 samples of the output of the photo diode 560 are stored within a memory device in drop detection unit 530. Drop detection unit 530 processes the sampled output current of the detector 454 to determine whether or not an ink droplet has crossed the collimated light beam 500 between the emitter 464 and the detector 454 and to analyze the characteristics of a particular nozzle based on the the sampled output current of the detector 454.

Drop detection unit 530 may also be configured to store in a memory device an indication of whether or not a nozzle of the plurality of nozzles comprising pen printhead 400 is fully functional, not ejecting ink at all (a "nozzle out" condition), firing off axis or sideways, or ejecting a smaller volume of ink than expected.

The concept of printmodes is a useful and known technique of printing a portion of the total drops required for an image in multiple passes. This tends to control bleed and cockle by reducing the amount of liquid that is on page at any given time.

The specific partial printing pattern employed in each pass, and the way in which these different patterns add up to a single fully inked image is known as a printmode. For instance a "one-pass" mode is one in which all dots to be fired on a given row of dots are placed on the media in one swath of the pen, and than the print medium is advanced into position for the next swath.

A two-pass mode is a print pattern wherein one-half of the dots available in a given row of available dots per swath are printed on each pass of the printhead, so two passes are needed to complete the printing for a given row. Similarly, a four pass mode is a print pattern wherein one forth of the dots for a given row are printed on each pass of the printhead, so four passes are needed to complete the printing for a given row.

The pattern used in printing each nozzle section is known as the "printmode mask" or "printmask" or sometime just "mask". A printmask is a binary pattern that determines exactly which ink drops are printed in a given pass or, to put the same thing in another way, which passes are used to print a each pixel of an image. The printmask may be used to select different nozzles for a particular dot so as to reduce undesirable printing artifacts.

Reference in this regard may be had to EP application no 98301559.5 which describes how to implement a plurality of selected print masks in order to accommodate error hiding, including nozzle out conditions, in multipass print modes.

Figure 7:
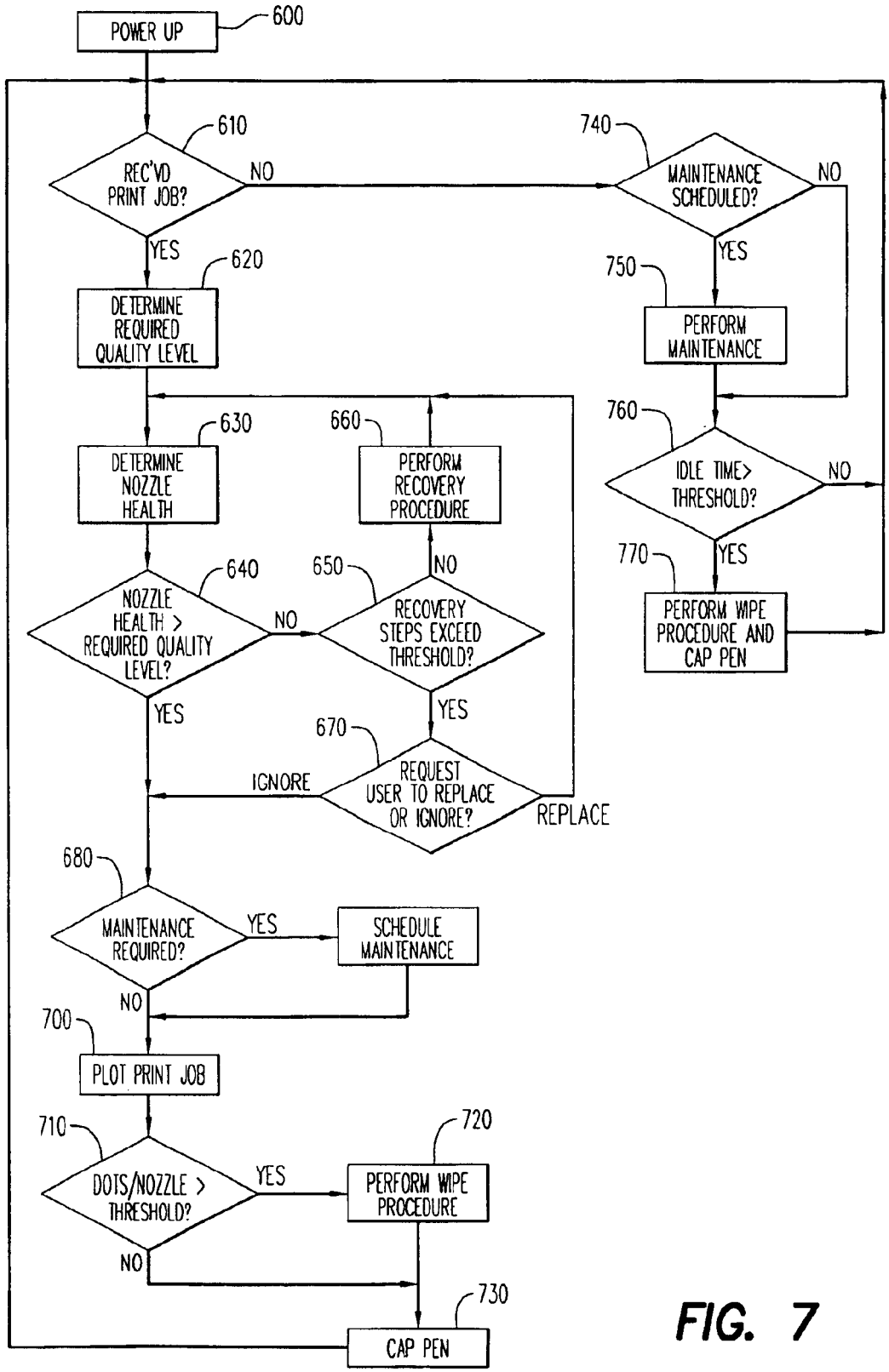
FIG. 7 shows a flow diagram of an example of the operation of a printer in initiating recovery procedures and scheduling maintenance procedures in accordance with the teachings of this invention.

An example of a method of performing service procedures in a manner that has a reduced impact on printer throughput, based on a flexible set of criteria will now be described with reference to FIGS. 7A and 7B.

In step 600, after power is applied to the printer 20, the printer 20 executes a series of power up procedures and then waits to receive a print job. Upon receiving a print job from the host (step 610), the printer 20 makes a determination as to the quality required for the particular print job (step 620). The quality determination may be based on the specified resolution (dots per inch) of the job. For example, a "draft" plot having a relatively low resolution will not require a high quality output as would be expected for a high resolution, "best quality" plot. The quality determination may be based on the printmode. For example, a job specifying a multipass printmode will usually require a higher quality output than a job specifying a single pass printmode. In addition, at least one of the settings of the printer 20 itself may be included in the quality determination. For example, a user may have set the printer 20 to print in an economy mode to save toner, or may have set the printer 20 to produce the fastest print. Also, the print quality may be dependent upon the media area required for the print job. A print job that includes an image having a large area may require a higher print quality and may have more print quality requirements than a job having a smaller image. A print job may also include various print quality requirements for different portions of the print job.

In step 630 the printer 20 then makes a determination of the nozzle health of each of the pens 50, 52, 54, 56. Nozzle health may include designations or indications that a nozzle is fully functional, non-functional, firing off axis or sideways, ejecting a smaller volume of ink than expected, or any other appropriate indication of nozzle health.

A comparison is made of the quality requirements of the print job and the nozzle health in step 640. If the nozzle health does not meet the quality requirements for the print job, a test is made (step 650) as to whether the number of nozzle recovery procedures for a particular pen have exceeded a predetermined threshold. If the threshold has not been exceeded, recovery procedures are performed (step 660) and nozzle health is again determined in step 630. If the threshold has been exceeded, the user is instructed in step 670 to either replace the pen or to indicate that the printer 20 should ignore the nozzle health indication for the particular pen. In the event that the user directs the printer 20 to ignore the nozzle health, the printer 20 proceeds with the plotting procedure as if the nozzle health met the quality requirements of the print job in step 640.

The printer 20 then proceeds to determine if maintenance of any of the pens is required (step 680). Maintenance requirements are determined according to various conditions, in general where the quality of the current print job is achievable but a nozzle or nozzles are not fully functional. Some factors for determining if maintenance requirements may include, for example:

a particular nozzle has not been fired for a particular period of time;

a number of nozzles have fired less than a predetermined number of drops over a particular time period;

a nozzle is firing off axis or sideways, or is ejecting a smaller volume of ink than expected but the quality criteria for the current print job are still being met.

If the printer 20 determines that maintenance is required, the printer 20 schedules a maintenance procedure in step 690. Maintenance is scheduled to be performed during printer down time, also referred to as idle time, defined as time when the printer 20 is not plotting and not testing any of its components. Down time may include periods when the printer 20 is waiting for a print job, while a print job is being downloaded, while user is loading media, or during power up procedures.

After scheduling the maintenance procedure, the printer 20 proceeds to plot 700. Upon completion of the plot a determination is made in step 710 of the number of dots fired per nozzle for a particular pen as of the last wiping operation. If the number of dots fired per nozzle exceeds a predetermined threshold, a spit, wipe, spit procedure as described earlier is performed on the pen in step 720. Otherwise the pen is capped (step 730) using cap 175 described earlier and the printer 20 waits for the next print job (step 610).

As mentioned above, maintenance is scheduled to be performed during printer down time. If maintenance has been scheduled (step 740) it is performed during this time. Maintenance procedures may include nozzle recovery procedures, or wipe, spit, wipe procedures as described above, or may include any operation performed by the printer 20 to restore a pen to proper working order.

If a maintenance procedure has not been scheduled, or has been completed during the printer down time, the idle time for each pen is calculated and compared to a predetermined threshold (step 760). In the event that the idle time has been exceeded, a wiping procedure is performed and the pen is capped in step 770. The printer then proceeds to wait for the next print job.

Thus, while the invention has been particularly shown and described with respect to preferred embodiments thereof, it will be understood by those skilled in the art that changes in form and details may be made therein without departing from the scope and spirit of the invention.

We claim:

1. A method of servicing a pen in an inkjet printing device, said pen comprising a plurality of nozzles, said method comprising:

receiving a print job;

determining a level of print quality required for said print job, wherein said level of print quality is based on a set of flexible criteria of the particular print job;

detecting the operating characteristics of a plurality of nozzles to be used to print said print job; and comparing said operating characteristics of said plurality of nozzles to said required level of print quality for said print job and, in the event, based on the comparison, that said operating characteristics of said plurality of nozzles are sufficient to meet said level of print quality, printing said print job.

2. The method of claim 1, wherein said set of flexible criteria includes a resolution of said print job.

3. The method of claim 1, wherein said set of flexible criteria includes a single and a multipass printmode of said print job.

4. The method of claim 1, wherein said set of flexible criteria includes a setting of said inkjet printing device.

5. The method of claim 1, wherein said set of flexible criteria includes an amount of media area required for said print job.

6. The method of claim 1, wherein detecting the operating characteristics of a plurality of nozzles further comprises performing a drop detection test on said plurality of nozzles.

7. The method of claim 1, further comprising scheduling a maintenance procedure in the event that an individual one of said nozzles is not fully functional.

8. The method of claim 7, wherein said maintenance procedure is scheduled to be performed during a time when said inkjet printing device is idle.

9. The method of claim 7, wherein said maintenance procedure includes performing a wiping procedure on said pen.

10. The method of claim 1, further comprising after printing said print job, performing a wiping procedure on said pen in the event that a predetermined number of ink drops per nozzle has been exceeded.

11. The method of claim 1, further comprising after printing said print job, performing a wiping procedure on said pen in the event that said inkjet printing device remains idle for a period of time.

12. The method of claim 1, further comprising performing a recovery procedure in the event that said operating characteristics of said plurality of nozzles are not sufficient to meet said level of print quality.

13. The method of claim 12, wherein said recovery procedure comprises a sequence of a plurality of different servicing procedures, and further wherein at least one of said plurality of different servicing procedures is repeatable, based on its recovery effectiveness.

14. The method of claim 1, wherein said step of printing is carried out without first performing any maintenance procedure.

15. The method of claim 1, wherein said step of determining is capable of determining that said print job and another print job have the same level or different levels of print quality.

16. An inkjet printing device for printing on a medium comprising:

a processor for determining a level of print quality required for a received print job, wherein said level of print quality is based on a set of flexible criteria of the particular print job;

an ink drop detector for detecting the operating characteristics of a plurality of nozzles to be used to print said print job;

said processor further being capable of comparing said operating characteristics of said plurality of nozzles to said required level of print quality for said print job, and in the event, based on the comparison, that said operating characteristics of said plurality of nozzles are sufficient to meet said level of print quality, causing said inkjet printing device to print said print job.

17. The inkjet printing device of claim 16, wherein said set of flexible criteria includes a resolution of said print job.

18. The inkjet printing device of claim 16, wherein said set of flexible criteria includes a printmode of said print job.

19. The inkjet printing device of claim 16, wherein said set of flexible criteria includes a setting of said inkjet printing device.

20. The inkjet printing device of claim 16, wherein said set of flexible criteria includes an amount of media area required for said print job.

21. The inkjet printing device of claim 16, wherein said processor operates to schedule a maintenance procedure in the event that one or more of said nozzles is not fully functional.

22. The inkjet printing device of claim 21, wherein said processor operates to perform said maintenance procedure during a time when said inkjet printing device is idle.

23. The inkjet printing device of claim 21, further comprising a printhead cleaning device, wherein said maintenance procedure includes performing a wiping procedure on said pen utilizing said printhead cleaning device.

24. The inkjet printing device of claim 16, further comprising a printhead cleaning device, wherein after printing said print job, said processor operates to perform a wiping procedure on said pen utilizing said printhead cleaning device in the event that a predetermined number of ink drops per nozzle has been exceeded.

25. The inkjet printing device of claim 16, further comprising a printhead cleaning device, wherein after causing said inkjet printing device to print said print job, said processor operates to perform a wiping procedure on said pen utilizing said printhead cleaning device in the event that said inkjet printing device remains idle for a period of time.

26. The inkjet printing device of claim 16, wherein said processor operates to perform a recovery procedure in the event that said operating characteristics of said plurality of nozzles are not sufficient to meet said level of print quality.

27. The inkjet printing device of claim 26, wherein said recovery procedure comprises a sequence of a plurality of different servicing procedures, and further wherein at least one of said plurality of different servicing procedures is repeatable, based on its recovery effectiveness.

* * * * *

UNITED STATES PATENT AND TRADEMARK OFFICE

CERTIFICATE OF CORRECTION

PATENT NO. : 6,938,971 B2
APPLICATION NO. : 09/886414
DATED : September 6, 2005
INVENTOR(S) : Rosa Maria Gomez et al.

It is certified that error appears in the above-identified patent and that said Letters Patent is hereby corrected as shown below:

ON THE TITLE PAGE

Inventors (75), delete "Gom z" and insert therefor --Gomez--

Claim 1, Column 9, line 54, after "print job" insert --received--

Claim 16, Column 10, line 47, after "print job" insert --received--

Signed and Sealed this

Eighth Day of September, 2009

David J. Kappos

David J. Kappos
*Director of the United States Patent and Trademark Office*